US008807864B2

(12) United States Patent
Kulkarni et al.

(10) Patent No.: US 8,807,864 B2
(45) Date of Patent: Aug. 19, 2014

(54) ROAD BARRIER ENERGY ABSORBING SYSTEMS AND METHODS FOR MAKING AND USING THE SAME

(75) Inventors: Sandeep Chandrakant Kulkarni, Bangalore (IN); Sudhakar Ramamoorthy Marur, Bangalore (IN)

(73) Assignee: Sabic Innovative Plastics IP B.V. (NL)

( * ) Notice: Subject to any disclaimer, the term of this patent is extended or adjusted under 35 U.S.C. 154(b) by 0 days.

(21) Appl. No.: 13/584,991

(22) Filed: Aug. 14, 2012

(65) Prior Publication Data

US 2014/0050524 A1 Feb. 20, 2014

(51) Int. Cl.
*E01F 15/00* (2006.01)

(52) U.S. Cl.
USPC ..... 404/6; 404/10

(58) Field of Classification Search
CPC ..... E01F 15/00
USPC ..... 404/6, 9, 10; 256/1, 13.1
See application file for complete search history.

(56) References Cited

U.S. PATENT DOCUMENTS

| | | | | |
|---|---|---|---|---|
| 3,493,213 | A * | 2/1970 | Ackerman | 256/13.1 |
| 4,678,166 | A * | 7/1987 | Bronstad et al. | 256/13.1 |
| 4,806,044 | A | 2/1989 | Duckett | |
| D341,098 | S | 11/1993 | Yodock | |
| 5,429,449 | A * | 7/1995 | Baatz | 404/6 |
| D379,668 | S | 6/1997 | Karanikas | |
| 5,988,934 | A | 11/1999 | Wasserstrom | |
| 6,149,134 | A * | 11/2000 | Bank et al. | 256/13.1 |
| D439,935 | S | 4/2001 | Tagg | |
| D441,409 | S | 5/2001 | Tagg | |
| 6,367,208 | B1 * | 4/2002 | Campbell et al. | 52/169.13 |
| 6,551,012 | B1 | 4/2003 | Hoebergen et al. | |
| D498,163 | S | 11/2004 | Brown | |
| D512,931 | S | 12/2005 | Brown | |
| D514,972 | S | 2/2006 | Brown et al. | |
| 7,445,402 | B1 * | 11/2008 | Chen | 404/6 |
| 7,543,369 | B2 * | 6/2009 | Burkett | 29/525.01 |

(Continued)

FOREIGN PATENT DOCUMENTS

| | | |
|---|---|---|
| DE | 102006058890 A1 | 6/2008 |
| JP | 2001164530 A | 6/2001 |
| WO | 0049232 | 8/2000 |

OTHER PUBLICATIONS

English Abstract of German Patent Application No. 102006058890; Date of Publication Jun. 5, 2008; 1 page.

(Continued)

*Primary Examiner* — Raymond W Addie
(74) *Attorney, Agent, or Firm* — Cantor Colburn LLP

(57) ABSTRACT

In an embodiment, a road barrier energy absorption unit can comprise: a vehicle crush section configured to absorb impact energy when impacted with greater than or equal to 5 kN force; a post channel configured to receive a road barrier post; and a guardrail attachment. The energy absorption unit can be disposed over the post and a guardrail can attach to the energy absorption unit. In an embodiment, a road barrier energy absorber system comprises: posts; road barrier energy absorption unit; and a guardrail extending between the energy absorber units. Each post is disposed in one of the energy absorber units. The energy absorber units comprise a vehicle crush section configured to absorb impact energy when impacted with greater than or equal to 5 kN force. In an embodiment, a guardrail can comprise: an outer wall and stiffening elements, wherein the guardrail comprises a plastic.

24 Claims, 12 Drawing Sheets

(56) References Cited

U.S. PATENT DOCUMENTS

| | | | | |
|---|---|---|---|---|
| 7,604,221 | B2 * | 10/2009 | Lass et al. | 256/13.1 |
| 7,819,604 | B2 * | 10/2010 | Breed | 404/6 |
| 7,997,824 | B2 * | 8/2011 | Amengual Pericas | 404/6 |
| 2004/0075893 | A1 * | 4/2004 | Cornelius | 359/361 |
| 2006/0099030 | A1 | 5/2006 | Yamasaki et al. | |
| 2006/0102883 | A1 * | 5/2006 | Troutman et al. | 256/13.1 |
| 2007/0110517 | A1 | 5/2007 | Wasserstrom et al. | |
| 2009/0050864 | A1 * | 2/2009 | Conway et al. | 256/13.1 |
| 2009/0090059 | A1 | 4/2009 | Bishop | |
| 2012/0003039 | A1 * | 1/2012 | Wallace et al. | 404/6 |

OTHER PUBLICATIONS

Japanese Patent No. 2001164530 (A); Publication Date: Jun. 19, 2001; Abstract Only; 1 Page.

International Search Report of The International Searching Authority; International Application No. PCT/IB2013/056538; International Filing Date: Aug. 9, 2013; Date of Mailing; Mar. 19, 2014; 4 Pages.

Written Opinion of The International Searching Authority; International Application No. PCT/IB2013/056538; International Filing Date: Aug. 9, 2013; Date of Mailing; Mar. 19, 2014; 4 Pages.

* cited by examiner

ROAD BARRIER ENERGY ABSORBING SYSTEMS AND METHODS FOR MAKING AND USING THE SAME

TECHNICAL FIELD

The present disclosure relates to an energy absorbing system, and especially to a road barrier energy absorbing system.

BACKGROUND

Energy absorber systems are typically used in automotive bumpers for the purpose of absorbing the impact energy generated by a collision. Mainly, the body in white and other components are designed to withstand certain impact load to meet regulation requirements. The energy absorber systems are intended to absorb energy and protect those components from damage. Thus, significant engineering and design effort has focused on designing safer and more durable vehicles.

In contrast, the environment in which the vehicle is operated, e.g., the surrounding infrastructures (such as, road barriers, road dividers, lamppost, parking garage walls and pillars, telephone poles, etc.) are designed as inflexible components that can withstand vehicle impact. Hence, they fail to safeguard the vehicle and the occupants during a collision between the vehicle and the infrastructure. Therefore, even if the vehicle is designed with all the safety technology, the chances of damage to the vehicle and/or occupant(s) still exist in collisions between the vehicle and the infrastructure.

There is a continuing need to enhance occupant safety and vehicle damageability during a collision with the barriers along the periphery of the road.

SUMMARY

Disclosed herein are road barrier energy absorbing systems, and methods for making and using the same.

In an embodiment, a road barrier energy absorption unit can comprise: a vehicle crush section configured to absorb impact energy when impacted with greater than or equal to 5 kN force; a post channel configured to receive a road barrier post; and a guardrail attachment. The energy absorption unit can be disposed over the post and a guardrail can attach to the energy absorption unit.

In an embodiment, a road barrier energy absorber system comprises: posts; road barrier energy absorption unit; and a guardrail extending between the energy absorber units. Each post is disposed in one of the energy absorber units. The energy absorber units comprise a vehicle crush section configured to absorb impact energy when impacted with greater than or equal to 5 kN force.

In an embodiment, a guardrail can comprise an outer wall and stiffening elements, wherein the guardrail comprises a plastic.

The foregoing and other features of the present disclosure will be more readily apparent from the following detailed description and drawings of the illustrative embodiments.

BRIEF DESCRIPTION OF THE DRAWINGS

The following is a brief description of the drawings wherein like numbers are numbered alike and which are presented for purposes of illustrating the exemplary embodiments disclosed herein and not for the purposes of limiting the same.

DETAILED DESCRIPTION

Disclosed herein are road barrier energy absorber systems. Compared to steel posts and metal guardrails, these road barrier energy absorber systems can reduce the injury level to the occupants during accidents, reduce damage to the vehicle, give extra reaction time to the driver to control the vehicle, and/or reduce head injury to an individual who impacts the barrier (e.g., a motorcyclist who impacts the barrier after falling).

The road barrier energy absorber system comprises a road barrier energy absorber unit (also referred to as an energy absorber unit), a post, and a guardrail. The post is a separate element onto which the energy absorber unit is disposed (e.g., a metal (e.g., steel), or composite post, which is affix to a horizontal surface and around which the energy absorber unit is located). For example, the post can be stabilized into the ground along a road side. The energy absorber unit can be attached over the post, and guardrail(s) can be attached to the energy absorber unit on the side comprising the vehicle crush section and optionally the head impact section. Optionally, an upper guardrail can be attached across the vehicle crush section and an optional lower guardrail can be attached across the optional head impact section. On the side of the energy absorber unit opposite the guardrail can be a secondary energy absorber for vehicle impact. The secondary energy absorber for vehicle impact can absorb additional energy to prevent the failure of the post. In other words, to prevent the post from bending sufficiently to allow a vehicle to cross the guardrail to the other side of the road barrier energy absorber system (e.g., to pass off the road, and/or into a ditch, and/or off a cliff).

Figure 19:
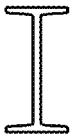
FIGS. 19-23 are top views of examples of post geometries.
Figure 20:
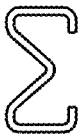
Figure 21:
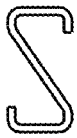
Figure 22:
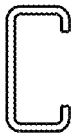
Figure 23:
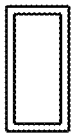

The post can be formed of any material capable of withstanding the desired impact energies without bending to a point wherein the vehicle can pass to the other side of the road barrier energy absorber system. Possible materials include metal such as steel. The post can have various geometries, including polygonal, rounded, and combinations comprising at least one of the foregoing, such as "I" (FIG. 19), "E" (FIG. 20), "S" (FIG. 21), "C" (FIG. 22), and rectangular (FIG. 23). During use, the post is attached to a horizontal surface (e.g., is anchored to the ground or other surface).

The guardrail can be of any shape, thickness, and material that can perform the desired function. For example, that can inhibit a vehicle from passing off the road, across the guardrail, without rupture, at an impact energy of 560 kJ. In other words, the roadside barrier system can meet the European impact requirements of EN 1317.2:1998.

The guardrail can comprise a material having sufficient strength and ductility (e.g., a ductility of greater than 40%, specifically, 40% to 80%, from −40° C. to 120° C., for example, metal (e.g., steel), plastic (e.g., thermoplastic), composite, as well as combinations comprising at least one of the foregoing). Examples of plastics include filled and unfilled materials such as: polycarbonate, polyester, polyolefins (e.g., polypropylene, polyethylene (such as high density polyethylene)), and combinations comprising at least one of the foregoing. Examples of possible guardrail materials include polycarbonate commercially available from SABIC Innovative Plastics under the trademark LEXAN* resins, and polyester-polycarbonate blends commercially available from SABIC Innovative Plastics under the trademark XENOY* resins. The guardrail can also be made with multimaterial system, e.g., with a weatherable material on outer side and the base structure on inner side. For example, the guardrail can be a base structure (e.g., a material having a ductility of greater than or equal to 40% at temperatures from −40° C. to 120° C.), and stiffening elements (e.g., ribs and the like) to form a structure having a modulus of greater than or equal to 3,000 megaPascals (MPa), specifically 3,000 MPa to 50,000 MPa, and more specifically, 10,000 MPa to 50,000 MPa, and with a weatherable coating on an outer surface of the base structure (e.g., a coating comprising an ultraviolet absorber). Optionally the guardrail can comprise non-plastic reinforcement. Possible reinforcement include metal, glass, ceramic, and combinations comprising at least one of the foregoing. The reinforcement can be in various forms such as fibers, particles, flakes, plates, wires, and so forth, as well as combinations comprising at least one of the foregoing.

Guardrail designs include wavy (e.g., "W" shaped) (see FIGS. 15-18). FIGS. 15-18 illustrate various embodiments of plastic (e.g., Xenoy* resin) guardrails. These guardrails can comprise a stiffening element(s) (82,84,86). For example, transverse stiffening element(s) and/or perpendicular stiffening element(s) and/or parallel stiffening element(s) 84 (see FIGS. 16 and 17). The transverse stiffening elements can include diagonal stiffening element(s) (e.g., stiffening elements extending from one side to the other side of the guardrail cross-section, at a non-perpendicular angle to the side 88 of the guardrail, forming triangular sections) (see FIG. 15). Perpendicular stiffening elements can include stiffening elements that extend from one side 88 to the other side 90 of the guardrail cross-section at an angle perpendicular to the outer wall (88,90) of the guardrail. (see FIGS. 16 and 18) The opening(s) 92, between the stiffening elements and the walls can optionally be filled, e.g., with foam or any other suitable material. Optionally, the outer wall can be thicker than the stiffening elements, e.g., to increase the buckling strength of outer walls and improve bending stiffness. For example, outer walls can have a thickness of up to and exceeding 15 mm, specifically, 2 mm to 10 mm, and more specifically, 2 mm to 8 mm, and yet more specifically, 4 mm to 8 mm. The stiffening elements can have a thickness of up to and exceeding 10 mm, specifically, 2 mm to 10 mm, and more specifically, 2 mm to 6 mm. As noted, the stiffening elements can have the same thickness as the outer wall or can have a thickness that is less than the thickness of the outer wall.

Figure 30:
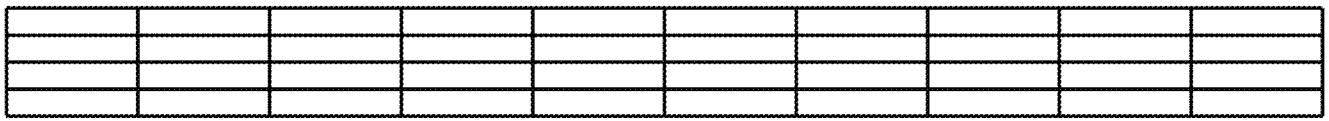
FIGS. 30-32 are cross-sectional illustrations of examples of possible stiffening element designs for polymer guardrails.
Figure 31:
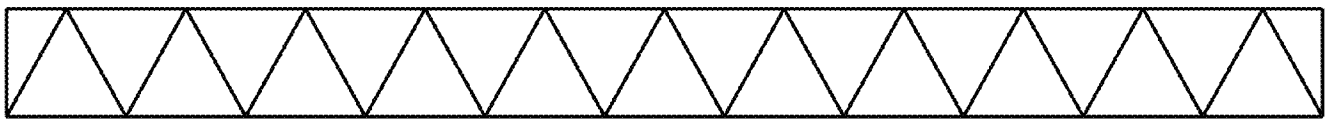
Figure 32:
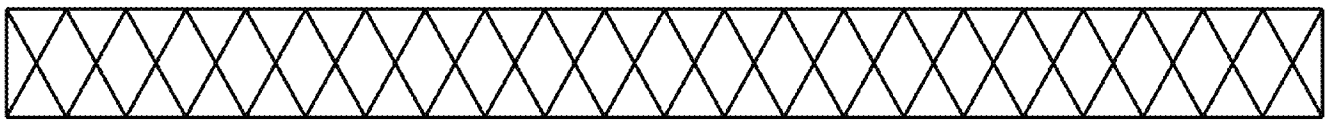

The stiffening elements can be located strategically. For example, gaps can be located between stiffening elements to form attachment elements. The attachment elements can be used to attach guardrails together and/or to the roadside energy absorber unit. Some stiffening element designs are illustrated in FIGS. 30-32, which show parallel and perpendicular stiffening elements (FIG. 30), zig-zag stiffening elements (FIG. 31), and multiple zig-zag stiffening elements which form parallelograms (FIG. 32.).

Figure 18:
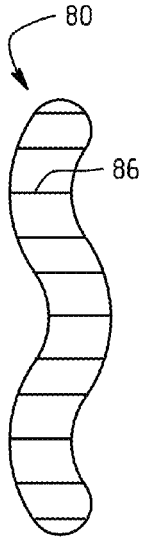

Various methods can be employed to form the guardrail including molding, extrusion, and so forth. FIG. 18 illustrates a guardrail formed by an injection molding method. Here, the W section design can be stiffened by stiffening elements on the rear side.

The guardrails can attach to the energy absorption unit with various attachment elements. Possible attachments include mechanical elements such as bolts, rods, and the like. A local steel insert can be used on the energy absorber unit to bolt the guardrail on the energy absorber unit, e.g., to avoid the creep. The metal (e.g., steel) elements can also be designed to absorb the energy, e.g. the steel inserts can be used on the front upper EA or the lower rear EA to absorb the energy.

Figure 2A:
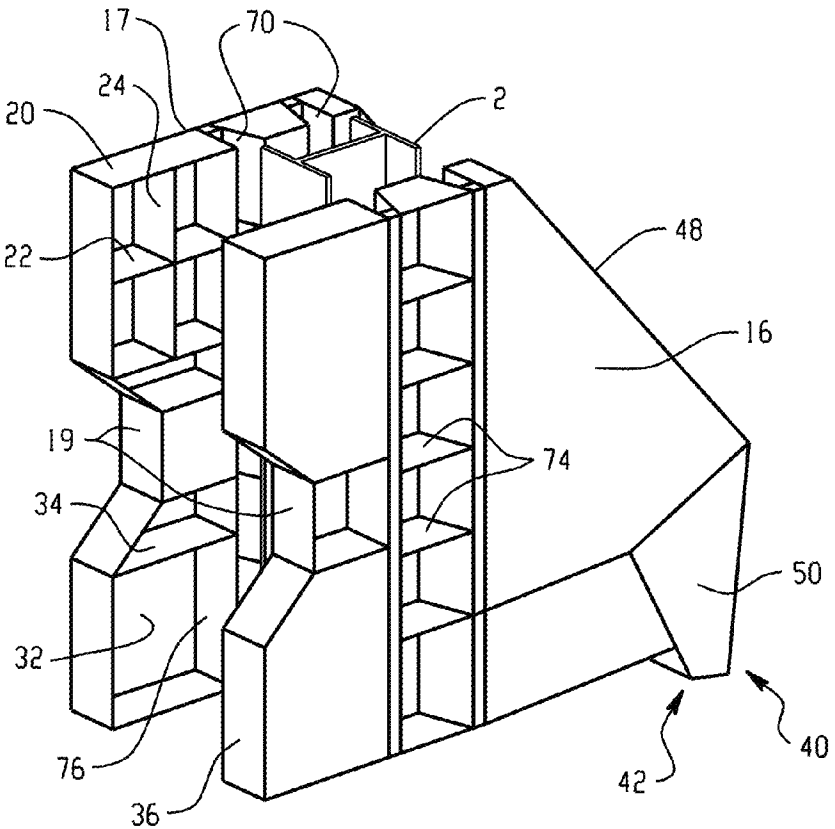
FIG. 2A is a perspective expanded view of the energy absorber assembly of FIG. 1.

The energy absorber unit, to which the guardrail attaches, is disposed around the post. The energy absorber unit can be modular or a single unitary component. The energy absorber unit can be produced using various forming techniques, depending upon the desired final design of the unit and the limitations of the forming technique. Some possible forming techniques include molding (e.g., injection molding, compression molding, blow molding, structural foam molding, thermoforming, etc.), extrusion, and combinations comprising at least one of the foregoing processes. For example, a single unitary unit can be formed via blow molding or injection molding. Multiple unit portions (e.g. two as illustrated in FIG. 2A) can be formed, for example, via injection molding.

In structural foam molding, a foaming agent is mixed with the polymer and injected into the cavity. The foaming agent produces a less dense cellular core on the center of the part thickness. This process can be used, for example, to enhance stiffness for the same weight of the material. An inert foaming gas and/or from the gases released from the chemical blowing agent can be used to obtain the cellular core. The parts produced through this process exhibit excellent strength to weight ratio. Sometimes as much as 40% weight reduction is possible using this process.

For example, the energy absorbing units can optionally be covered with aesthetic cover. The energy absorbing units can be designed to crush progressively during impact while maintaining desired force level.

The units can comprise connectors capable of aligning the units and/or of retaining the units together. The connectors can be chemical (e.g., adhesive), and/or mechanical (e.g., complementary protrusions and grooves, snap fit connections, bolts, rivets, etc.). Depending upon the assembly technique, e.g., snap fit or another reversible process, the components of the units can be easily dismantled and reassembled so that portions of units can be replaced without the need to replace the whole unit.

Steel barriers are used typically on the highways. Design consists of a steel post, which can be, for example, an I, C, S, or O cross-section. A separator (e.g., rigid wooden block or C-section) is fixed on the post. Steel W-shape beam (guardrail) is fixed to the separator, which runs along the road length. The steel posts are typically spaced 2 meters (m) apart, although other spacing can be employed if additional energy absorber units are desired.

Figure 1:
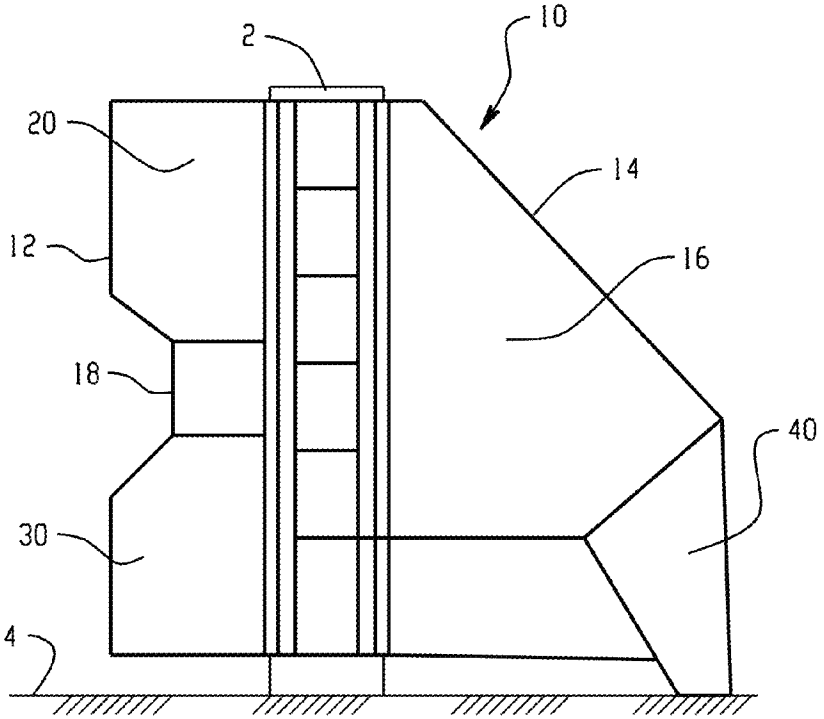
FIG. 1 is a side view of an embodiment of an energy absorber assembly comprising an energy absorber unit disposed around a post, e.g., for use as a roadside barrier.
Figure 6:
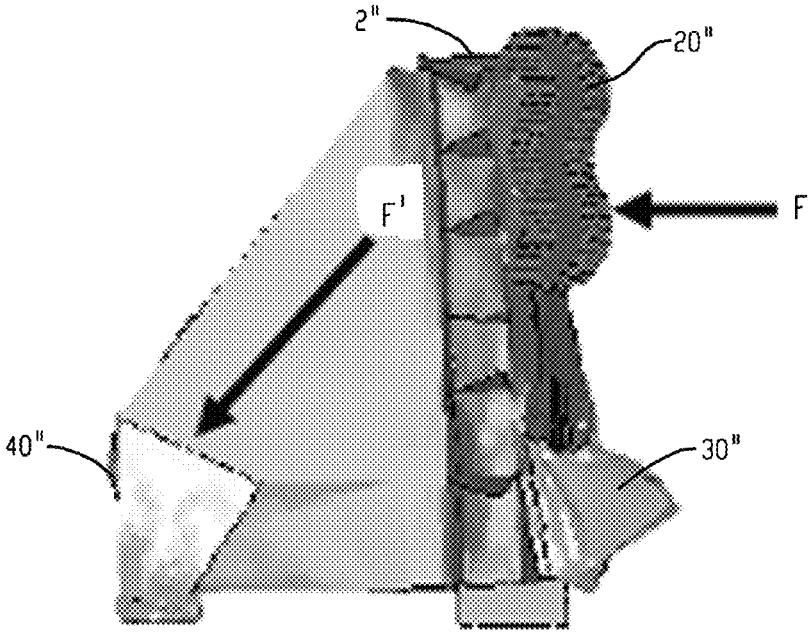
FIG. 6 is a side view of an embodiment of a crushed roadside barrier energy absorber.
Figure 7:
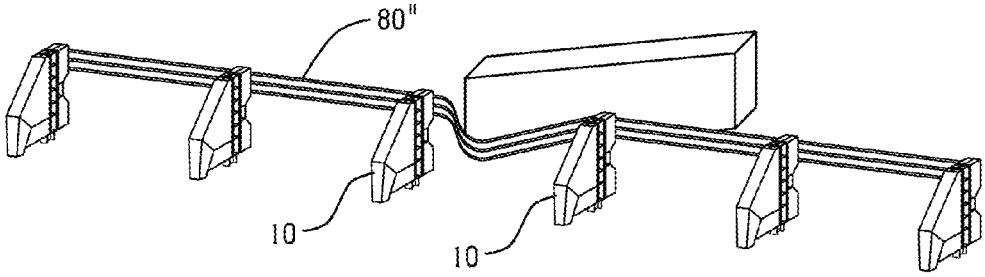
FIG. 7 is a perspective view of an embodiment of a crushed partial roadside barrier absorber system for center impact.

For roadside barriers, the energy absorber unit can be added on the steel post to improve the energy absorption for vehicle impact and/or human impact. (see FIG. 1, illustrated schematically in FIG. 3) For example, two energy absorber portions 20,30 can be designed on front side to safeguard against vehicle impact and to safeguard against human body impact (e.g., a motorcyclist falling off of the motorcycle). Optionally, a second level energy absorber 40 can be designed on the rear side thereof, e.g., to further support the post and hence further inhibit failure of the guardrail (e.g., further prevent a vehicle from crossing the guardrail). The second level energy absorber can be designed to crush against the horizontal surface 4 (e.g., the ground) when force is applied to the frontside vehicle energy absorption portion. For example, as is illustrated in FIG. 6, a force "F" contact (and crushes) the frontside absorber, and extra force "F'" (non-absorbed force), pushes the post 2 in the direction of the original force "F", causing the post 2 to bend, and the force "F'" to be absorbed by the second level energy absorber 40. (See FIGS. 1,2A,2B, 6) In such a design, the horizontal surface along with the secondary energy absorber for vehicle impact, both absorbs the impact energy and inhibits the post failure. Post failure can allow the vehicle to proceed across the barrier.

Each road barrier energy absorber unit can be designed for the desired energy absorption. For example, lower energy absorber (30) can be designed to take head impact load to meet the HIC criterion. Upper energy absorber (20) can be designed for the slow speed impact. It can be relatively soft structure to reduce damage to the vehicle. While the energy absorber on the rear (40) will be rigid structure which will get contacted with road and crush.

To attain the desired structural integrity and crush characteristics, each energy absorber portion 20,30,40 can comprise stiffening element(s). For example, the vehicle crush section 20 needs a higher crush capability than the head impact section 30 (e.g., can have greater than or equal to 5, specifically greater than or equal to 10 times, the crush capabilities of the head impact section 30). For example, the vehicle crush section can absorb 5 kJ to 40 kJ of impact energy, specifically, 10 kJ to 40 kJ, and more specifically, 20 kJ to 35 kJ of impact energy. For example, the head impact section can absorb 1 kJ to 10 kJ of impact energy, specifically, 2 kJ to 10 kJ, and more specifically, 5 kJ to 10 kJ of impact energy. The second level energy absorber can absorb greater than or equal to 30 kJ, specifically 30 kJ to 200 kJ or more of impact energy, more specifically, 50 kJ to 200 kJ, yet more specifically, 100 kJ to 200 kJ, and still more specifically, 150 kJ to 200 kJ of impact energy.

The head impact section 30 can be a hollow area formed by an upper crush wall 34 and a lower crush wall 36. These crush walls 34,36 can extend from the post 2 to a front wall 38 extending from crush wall 34 to crush wall 36 (e.g., crush walls 34,36 can extend perpendicular from the post 2 and/or the front wall 38 can extend perpendicular to crush walls 34,36 and/or parallel to post 2). Optionally, a space formed between the post and walls 34,36,38 can be hollow or it can be filled with a compliant material (e.g., a foam, gel, or other material).

Figure 24:
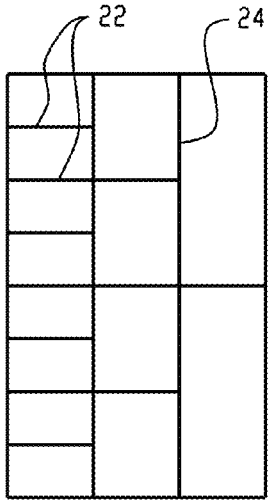
FIGS. 24-26 are cross sectional views of embodiments of vehicle crush section designs with various stiffening element configurations.
Figure 25:
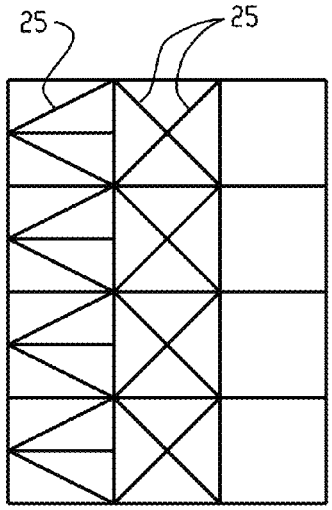
Figure 26:
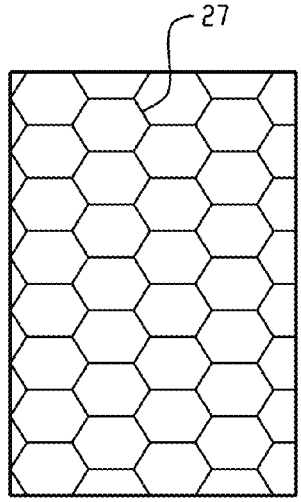

Since the vehicle crush section 20 has greater structural integrity than the head impact section 30, it has stiffening element(s) (or more stiffening element(s)), and/or is filled. For example, as with the head impact section 30, vehicle crush section 20, can comprise protruding walls 26 extending from the post 2, and front wall 28 extending between the protruding walls 26 (e.g., protruding walls 26 can extend perpendicular from the post 2 and/or the front wall 28 can extend perpendicular to crush walls 26 and/or parallel to post 2). Located between the protruding walls 26 and/or between the front wall 28 and the post 2 can be stiffening element(s) 22,24. Optionally, the stiffening element(s) can comprise a steel insert that can, for example, also absorb energy. The perpendicular and the parallel stiffening elements can be more than one to create stiffening element skeleton. Alternatively, or in addition, the area can be filled with hexagonal stiffening elements (honeycombs). (See FIGS. 24-26) Each stiffening element is oriented parallel, perpendicular, or diagonal to the post 2 in order to attain the desired crush characteristics. For example, the vertical stiffening element(s) 24, between the post 2 and front wall 28, can be parallel to the post 2. Optionally, the horizontal stiffening element(s) 24, between the walls 26, can be perpendicular to the post 2. If further structural integrity is desired, the stiffening element(s) 22 can be oriented at an angle (i.e., other than 90 degrees) to the post 2 such that multiple stiffening elements converge toward the front wall 28, forming triangular structure(s) in the vehicle crush section 20. Other stiffening element combination can also be designed as shown in FIGS. 24-26.

Between vehicle crush section 20 and head impact section 30 can be further energy absorption, or an area of reduced material. For example, concave area 18 can be located therebetween, e.g., to reduce material consumption in forming the energy absorber unit 10, and/or to add aesthetic qualities. As can be seen in FIGS. 1 and 2A, the concave area 18 can be formed by walls converging both toward the post 2 and/or toward the opposite side 16 or 17. Optionally, the front most portion of the concave area 18 can be open (FIGS. 1 and 2B), or can comprise a front wall 19 (FIG. 2A).

The energy absorber units can be, for example, injection molded. The wall and/or stiffening element thicknesses can be 3.0 to 8.0 millimeters (mm) thick. Outer wall(s) can be thicker compared to the stiffening elements, wherein the stiffening elements in combination with outer walls are designed to absorb the required impact energy. The openings formed between the stiffening elements and walls can optionally be filled with foam and/or any alternative suitable material, e.g., to modify the energy absorption characteristics. Optionally, the stiffening elements(s) can include steel insert(s) which can optionally further absorb energy.

Figure 2C:
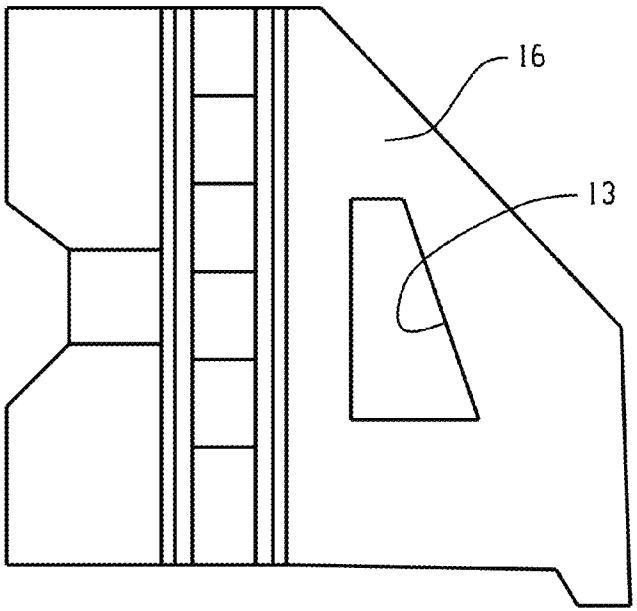
FIG. 2C is a side view of another embodiment of an energy absorber assembly further illustrating an optional opening.
Figure 2B:
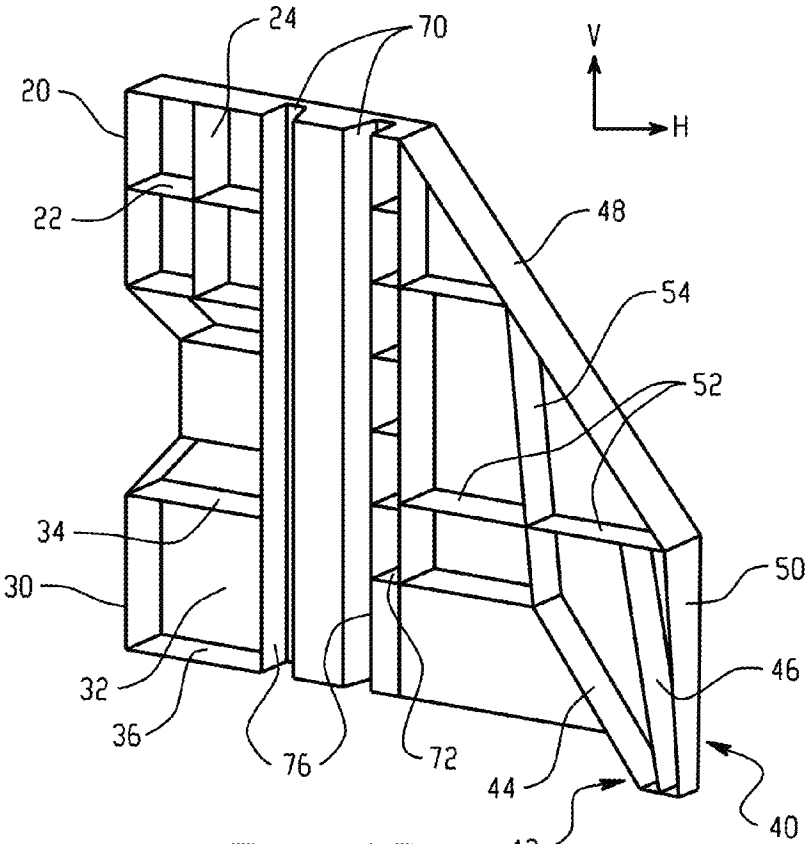
FIG. 2B is a perspective view of one section of the energy absorber unit of FIG. 1.
Figure 3:
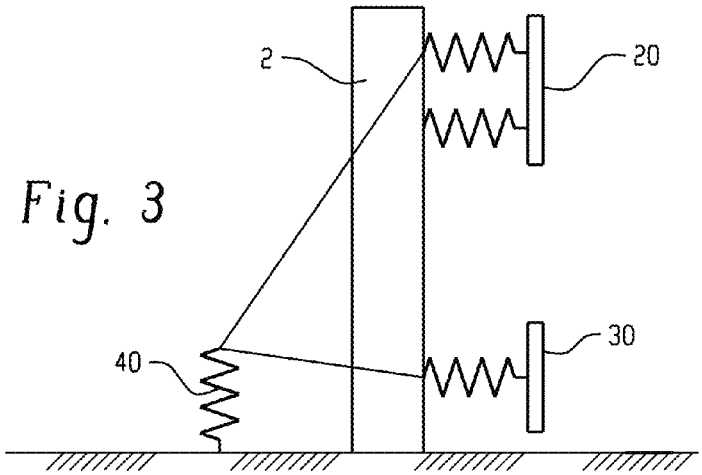
FIG. 3 is a schematic view of an embodiment of an energy absorber assembly for a roadside barrier designed for both vehicle and head impact.

The post 2 can be located through the energy absorber unit 10 in a hollow area that is simply open or that is formed to the particular post shape (e.g., configured to an I beam as is illustrated in FIGS. 2A,2B). Here, post channels 70 are formed between vertical stiffening elements 76 (which can optionally extend along the post 2, forming one side of the head impact section 30 and/or the vehicle crush section 20).

On the rear side of the post 2 can be the secondary energy absorber 40. Since the secondary energy absorber 40 has a much higher crush capability than the vehicle crush section 20 (e.g., can have greater than or equal to 5, specifically, greater than or equal to 10 times the crush capabilities of the vehicle impact section 20) it can have additional stiffening element(s) and/or filler. As is illustrated, the secondary energy absorber 40 can have a series of horizontal transfer stiffening element(s) 52 which can extend from a vertical post stiffening element 76 to a transverse wall 48 and/or to a horizontal foot wall 50. Horizontal foot wall 50 can be substantially parallel to the post 2. Optionally the horizontal foot wall 50 can have an angle of 10° to 90° from a vertical axis "V". Optionally, the transverse wall 48, can extend away from the vertical stiffening element(s) 76 to the horizontal stiffening element(s) 50. Horizontal stiffening element(s) 50, along with angled stiffening element 44, form the foot 42 that enables transfer of crush energy from vehicle, to the post 2 and to the ground (e.g., horizontal surface 2). Optionally, the foot 42 can comprise support stiffening element(s) 46, e.g., disposed between horizontal stiffening element 50 and angled stiffening element 44. For example, a support stiffening element 46 can extend between the horizontal stiffening element 50 and angled stiffening element 44 to divide the space therein in half.

Figure 27:
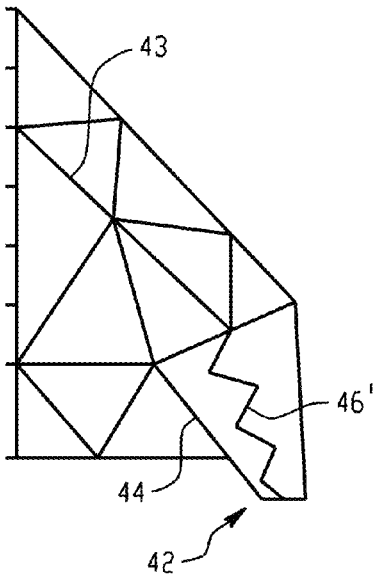
FIGS. 27-29 are cross sectional views of embodiments of secondary energy absorber for vehicle impact designs with various stiffening element configurations.
Figure 28:
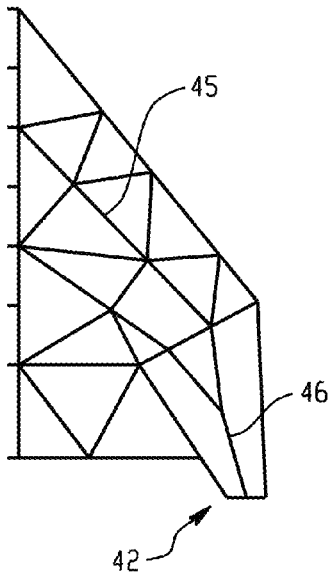
Figure 29:
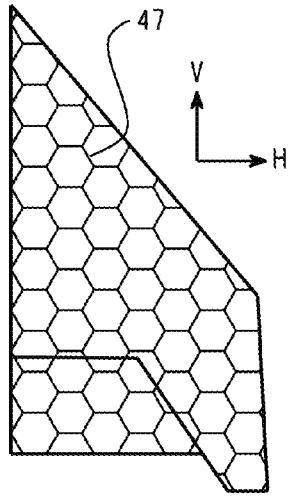

Other stiffening element combination can also be designed as shown in FIGS. 27-29. These figures illustrate interior designs of the secondary energy absorber. As can be seen, various combinations of diagonal (not parallel or perpendicular to the surface to which the assembly is mounted (other than "H" or "V" axes)), horizontal ("H") (parallel to the surface to which the assembly is mounted), and vertical ("V") (perpendicular to the ground (surface to which the assembly is mounted)). FIGS. 27 and 28 illustrate multiple triangular sections which provide further structural integrity. It is noted that in these figures, other optional stiffening element designs in the foot 42 are illustrated. FIG. 27 illustrates a zig-zag stiffening element 46' that extends from a base of the foot 42. FIG. 28 illustrates a straight stiffening element 46 that extends from the base of the foot 42 to diagonal ribs such that the stiffening element 46 ends at the peak of a triangle. FIG. 29 illustrates honeycomb stiffening elements (e.g., multiple hexagonal cells). When honeycomb stiffening elements are used, the amount of cells is dependent upon the desired energy absorption as well as the molding capabilities of the tooling. Optionally, the side of the cell can be greater than or equal to 10 mm.

Figure 4:
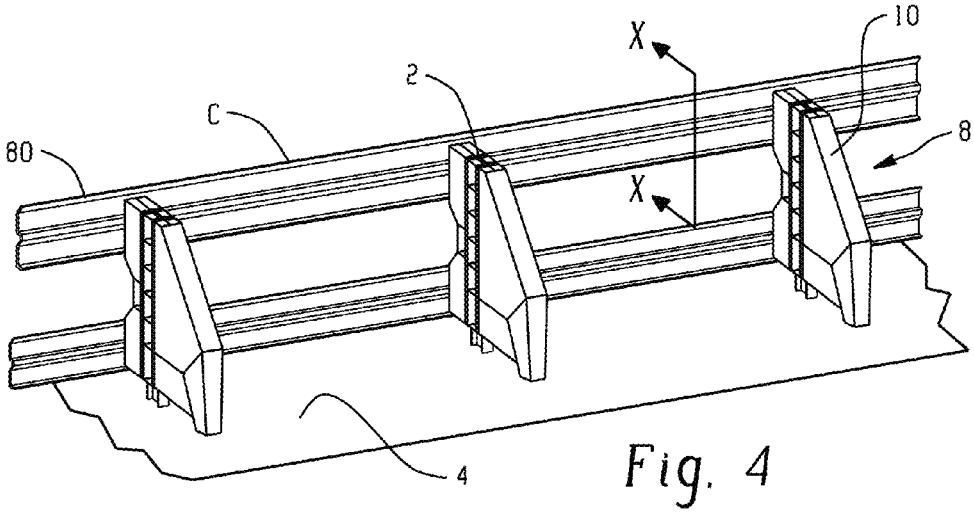
FIG. 4 is a partial view of a roadside barrier system using the energy absorber assembly and post of FIG. 1.

These energy absorber units can be placed on each post (e.g., steel post). These energy absorbers are also designed to fit on the existing steel post so replacement of this post is not needed. For example, as is illustrated in FIG. 4, which illustrates a cut-way portion of a roadside barrier system with a complete assembled energy absorption units on the steel posts. Here, polymer energy absorption units are fixed around the steel post and the polymer W beam is affixed to the energy absorption units.

Polymeric or composite materials can be used for manufacturing of the energy absorber and/or guardrail. Some examples of materials include for example, possible thermoplastic materials include polybutylene terephthalate (PBT); acrylonitrile-butadiene-styrene (ABS); polycarbonate (PC) (LEXAN* and LEXAN* EXL resins, commercially available from SABIC Innovative Plastics); polycarbonate/PBT blends; polycarbonate/ABS blends; copolycarbonate-polyesters; acrylic-styrene-acrylonitrile (ASA); acrylonitrile-(ethylene-polypropylene diamine modified)-styrene (AES); phenylene ether resins; blends of polyphenylene ether/polyamide (NORYL GTX* resins, commercially available from SABIC Innovative Plastics); blends of polycarbonate/polyethylene terephthalate (PET)/PBT; polybutylene terephthalate and impact modifier (XENOY* resins, commercially available from SABIC Innovative Plastics); acrylic-styrene-acrylonitrile (ASA, GELOY* resins, commercially available from SABIC Innovative Plastics); polyamides; phenylene sulfide resins; polyvinyl chloride PVC; high impact polystyrene (HIPS); polyethylene; low/high density polyethylene (L/HDPE); polypropylene (PP) (e.g., reinforced polypropylene; glass fiber reinforced polypropylene; long glass fiber reinforced polypropylene); expanded polypropylene (EPP); polyethylene and fiber composites; polypropylene and fiber composites; long fiber reinforced thermoplastics (VERTON* resins, commercially available from SABIC Innovative Plastics) and thermoplastic olefins (TPO), as well as combinations comprising at least one of the foregoing. For example, the material can be PC/PBT, a polyolefin (e.g., polypropylene such as glass filled polypropylene, long glass fiber polypropylene, etc.) as well as combinations comprising at least one of the foregoing. Particularly useful polymers include polybutylene terephthalate and impact modifier (XENOY* resins, commercially available from SABIC Innovative Plastics), polycarbonate (PC) (LEXAN* and LEXAN* EXL resins, commercially available from SABIC Innovative Plastics), and combinations comprising at least one of the foregoing resins.

An exemplary filled resin is STAMAX* resin, which is a long glass fiber filled polypropylene resin also commercially available from SABIC Innovative Plastics. Some possible reinforcing materials that can be used in any of the above described materials include fibers, such as glass, carbon, natural, modified natural, modified glass, modified carbon, polymeric, and so forth, as well as combinations comprising at least one of the foregoing; e.g., long glass fibers and/or long carbon fiber reinforced resins; fillers, such as mineral fillers.

The glass fibers and/or carbon fibers can be long or short, or a combination thereof. Combinations comprising at least one of any of the above-described materials can also be used.

Optionally, a radio frequency identification (RFID), or the like, can be embedded in the structure to obtain and/or retain desired information.

During the impact, energy is transferred to the vehicle crush section 20 and/or the head impact section 30. If the energy is beyond the absorption capabilities of the vehicle crush section 20, energy transfers to the post 2, bending it back, and transferring energy to the secondary energy absorber 40. The energy transfer prevents recoil toward the vehicle and/or individual, thereby enabling greater reaction time and a greater opportunity to minimize physical and property damage.

Optionally, energy absorber units have a reflector (e.g., a reflective coating), e.g., to enhance visibility of the unit in low visibility situations (e.g. at night).

The following non-limiting examples are intended to further illustrate the energy absorber systems.

EXAMPLES

Simulations

Example 1

Figure 5A:
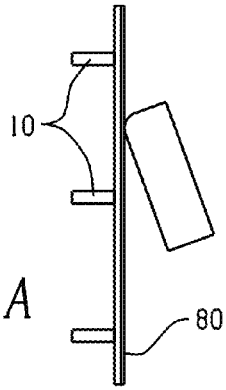
FIG. 5A is an overhead plan view of an illustration of an impact analysis setup for a roadside barrier energy absorber system where impactor is impacting at an angle 20 deg on the post.
Figure 5B:
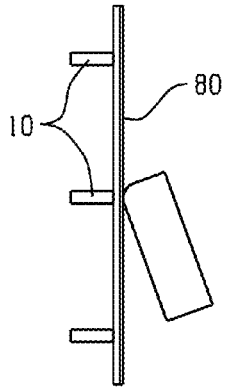
FIG. 5B is an overhead plan view of an illustration of an impact analysis setup for a roadside barrier energy absorber system where impactor is impacting at an angle 20 deg between adjacent posts, e.g., at the center of the guardrail between adjacent posts.
Figure 8A:
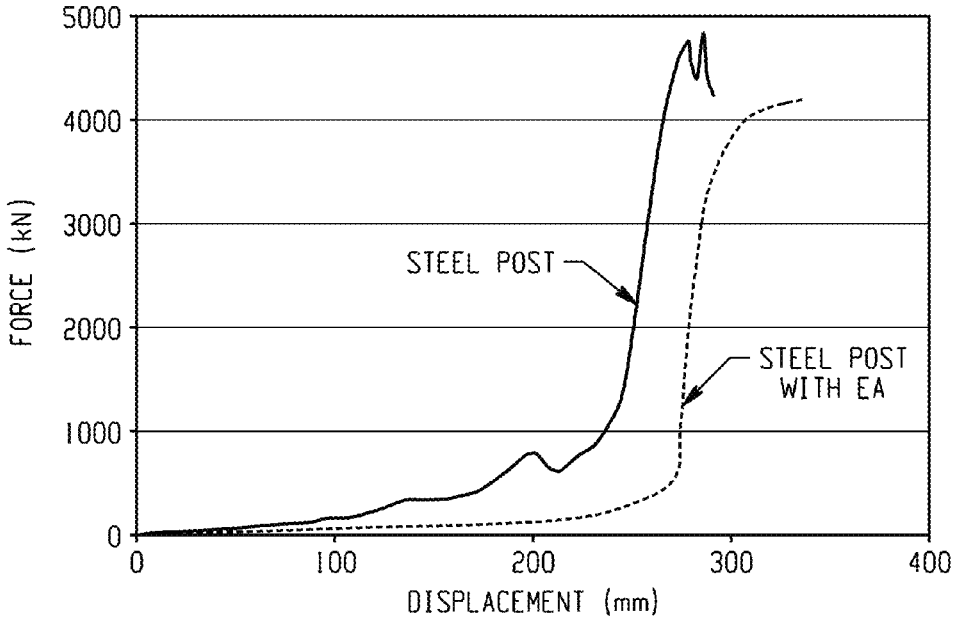
FIG. 8A is a graphic illustration of a force deformation curve for the energy absorber of FIG. 4, using the setup of FIG. 5A for impact on post.
Figure 8B:
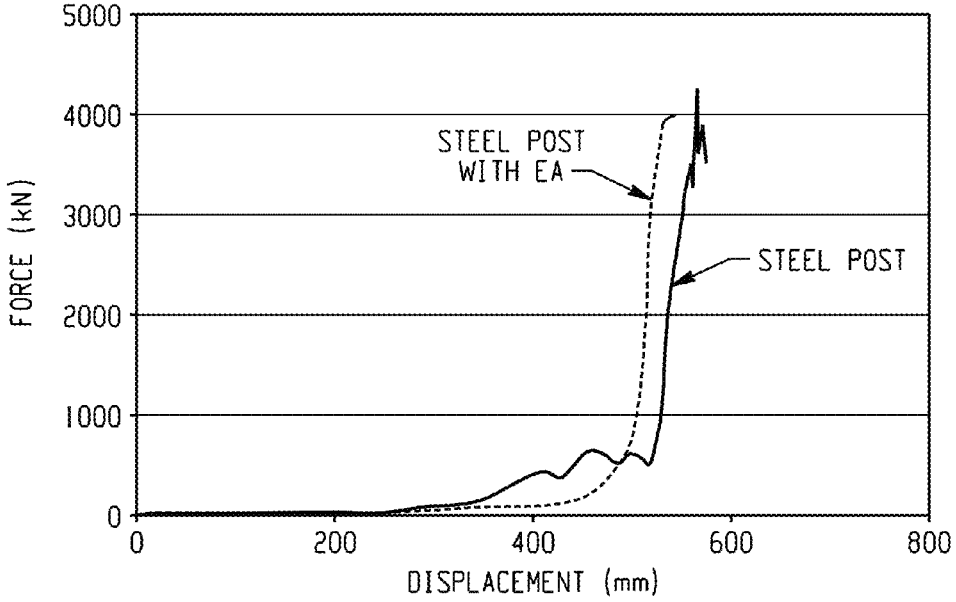
FIG. 8B is a graphic illustration of a force deformation curve for the energy absorber of FIG. 4, using the setup of FIG. 5B for impact on the guardrail between adjacent posts ("center impact").
Figure 9:
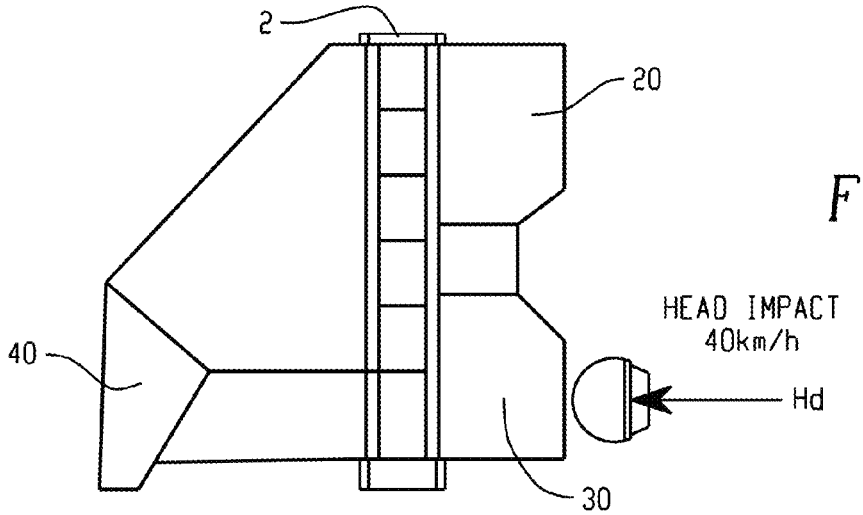
FIG. 9 is a side view of an embodiment of an energy absorber assembly with head impact absorption capabilities, and illustrating the head impact location.
Figure 33:
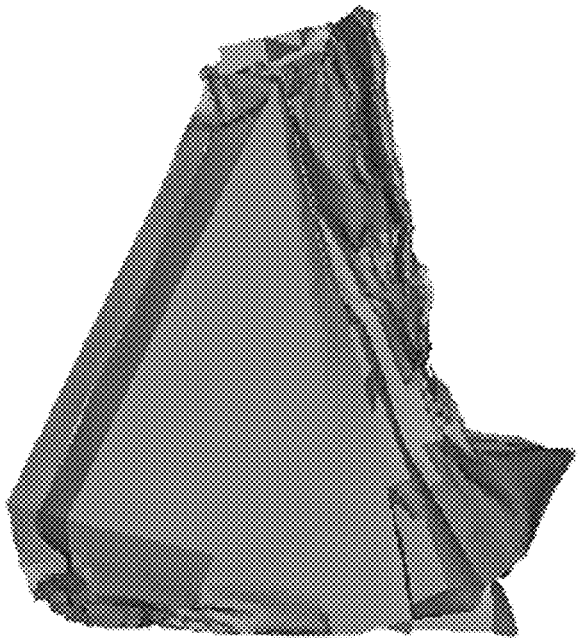
FIG. 33 is a perspective side view of the crushed energy absorber assembly impacted with 500 kJ of energy.
Figure 34:
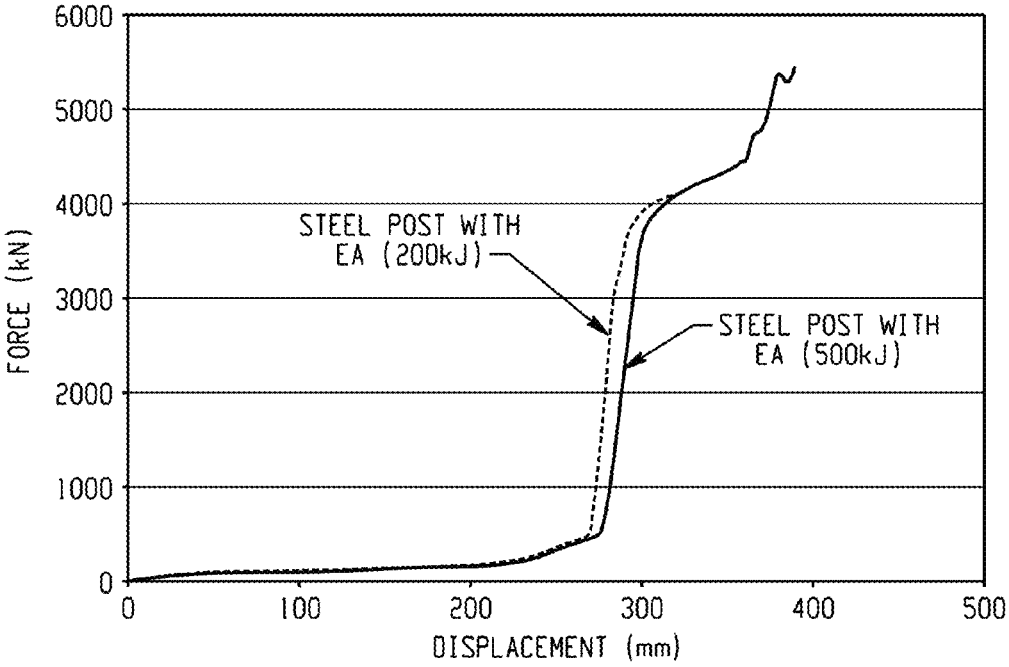
FIG. 34 is a graphical illustration of force versus displacement for an energy absorber assembly impacted with 200 kiloJoules (kJ) and 500 kJ of energy.
Figure 35:
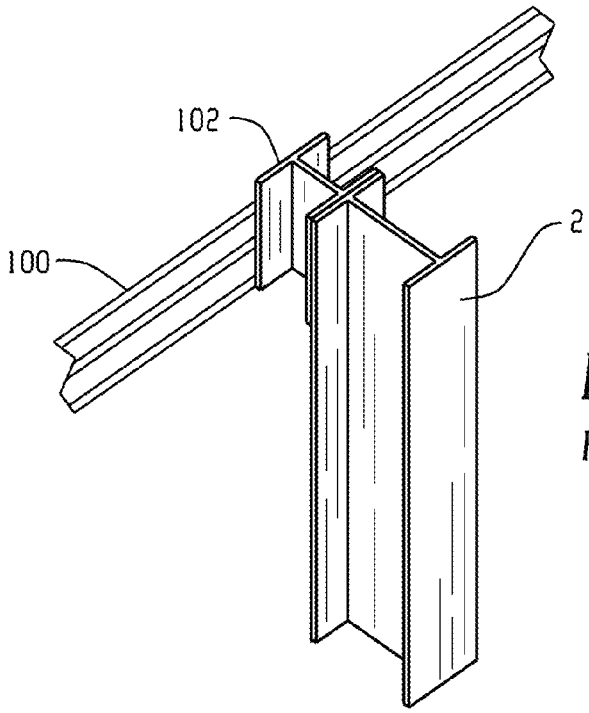
Fig. 35 PRIOR ART
FIG. 35 is a perspective view of a prior art road barrier.
Figure 36:
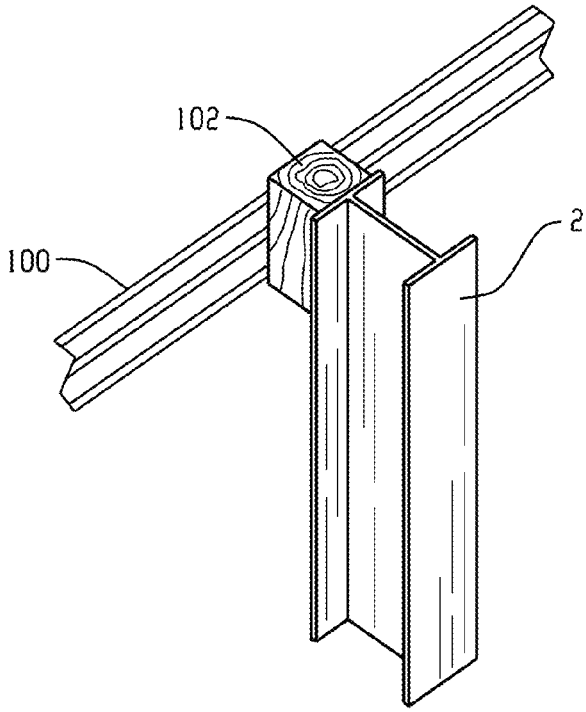
Fig. 36 PRIOR ART
FIG. 36 is a perspective view of another prior art road barrier.

Road barriers are analyzed for the impact load. The assembly will be impacted with the rigid impactor with total energy of 200 kJ. FIG. 5 shows the impact setup. The impactor impacts at an angle of 20°. FIG. 6 shows the crushing of the energy absorption units during impact. The upper part of the energy absorption unit crushes during the vehicle impact. FIG. 8 graphically illustrates a force deformation comparison of road barrier with and without energy absorption unit. The energy absorption unit can provide higher reaction time during impact, also the reaction force will be lesser compared to the road barrier without an energy absorption unit. The energy absorsion in the first 200 millimeters (mm) intrusion level is by the front upper energy absorber (the vehicle crush section), which is designed to crush and transfer lower reaction force to the vehicle. After the front energy absorber crushes, the load is transfer to the steel post and the rear energy absorber (the secondary energy absorber for vehicle impact) to absorb the energy. In case the impact energy increased to 500 kJ, higher energy will be transferred to the rear energy absorber. FIG. 33 shows the crushing of the energy absorption unit during impact. FIG. 34 graphically illustrates a force-deformation comparison of the road barrier with energy absorption unit for 200 kJ and 500 kJ energy.

Example 2

Figure 10:
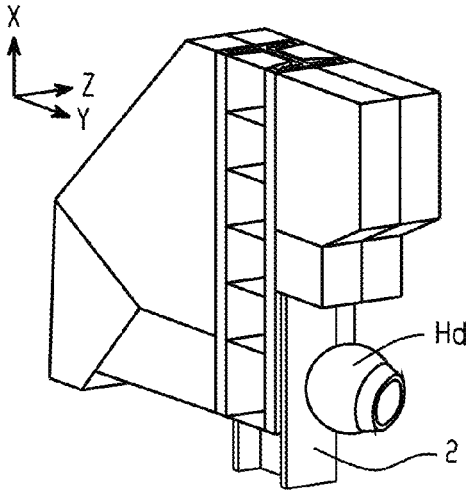
FIG. 10 is a perspective view of a head impact with no head impact energy absorber between the post and the head ("Hd").
Figure 11A:
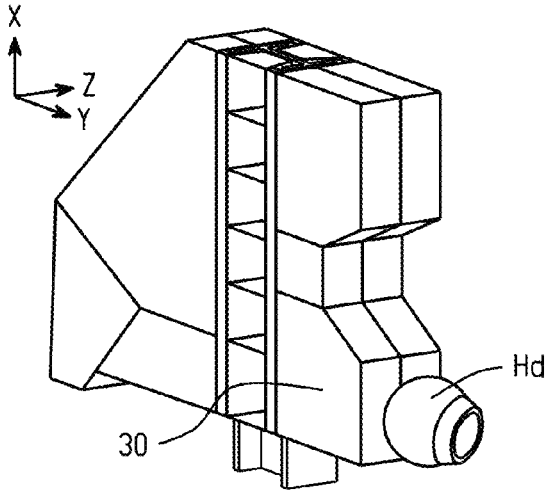
FIG. 11A is a partial perspective view of a head impact with an example of an energy absorber between the post and the head ("Hd").
Figure 11B:
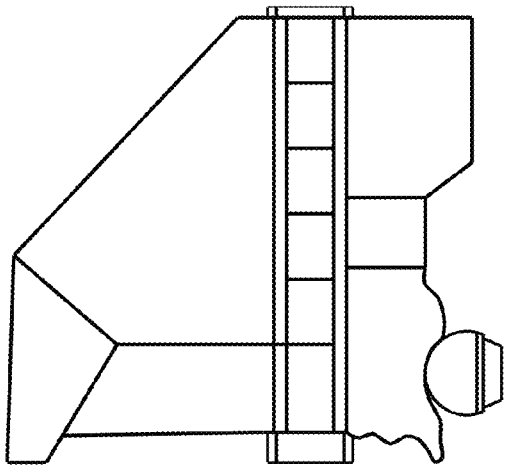
FIG. 11B is a side view of the energy absorber of FIG. 11A that has been impacted in the lower impact area; the head ("Hd") impact.
Figure 12:
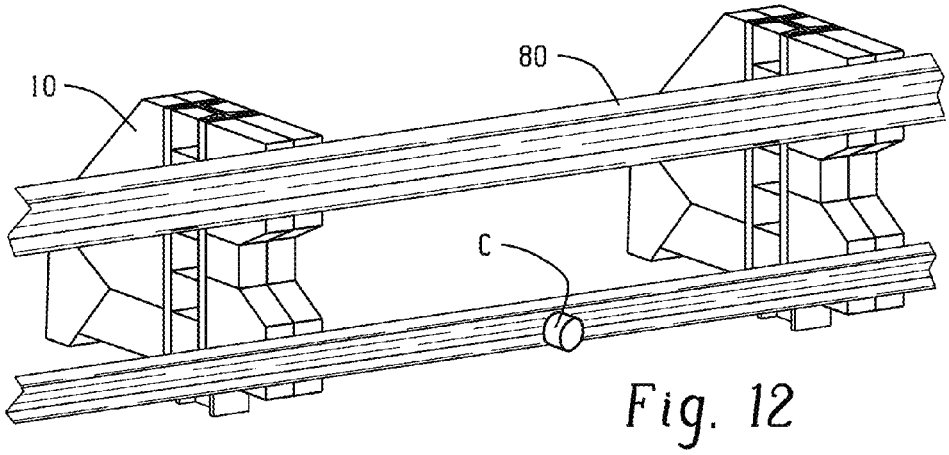
FIG. 12 is a perspective view of a partial roadside barrier system illustrating a center head impact location (between adjacent energy absorber assemblies) on a lower guardrail.
Figure 13:
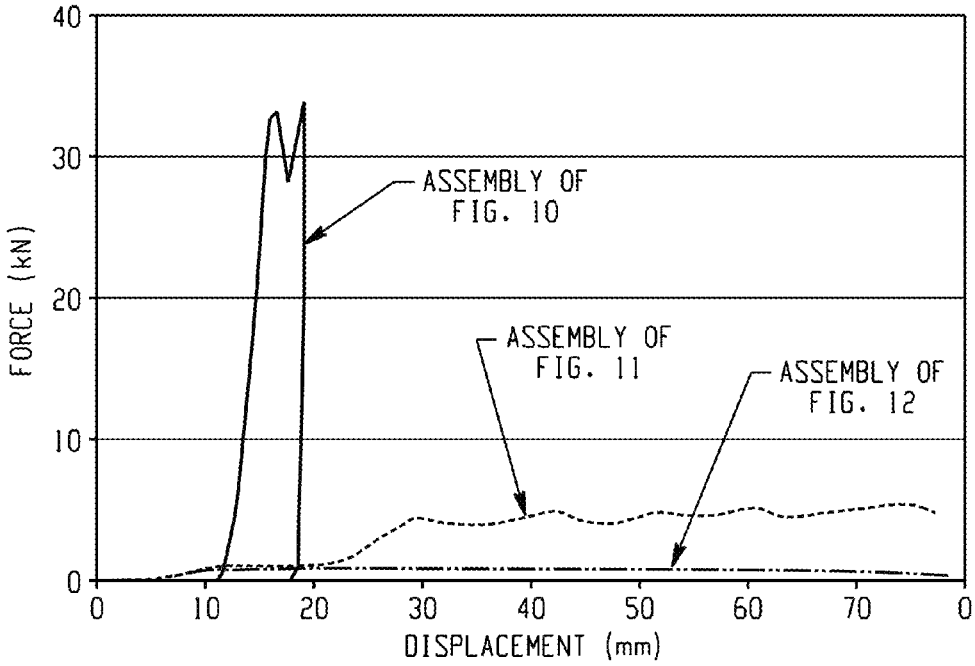
FIG. 13 is a graphic illustration of a force deformation curve for the energy absorber assembly (EAA) of FIG. 10, and FIG. 11, and FIG. 12, using the setup of FIG. 9.
Figure 14:
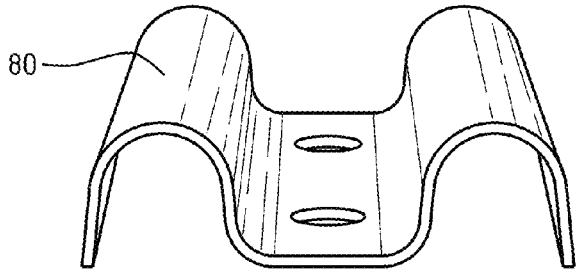
FIG. 14 is a perspective side view of a partial metal guardrail.
Figure 15:
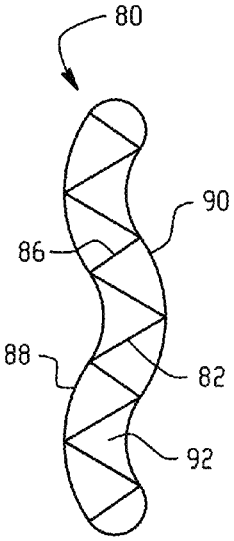
FIGS. 15-18 are cross-sectional views, taken along lines X-X of FIG. 4, of examples of plastic guardrails comprising stiffening elements.
Figure 16:
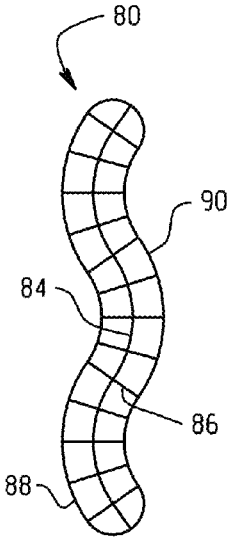
Figure 17:
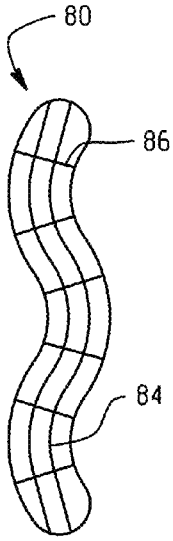

Head impact studies are carrier out where head is impacted at velocity of 40 km/h on a steel pole (see FIG. 10), a polymer energy absorption unit (see FIG. 11A), and between adjacent energy absorber units, along a lower polymer guardrail (see FIG. 12). FIG. 13 shows the force deformation curves. Studies indicate that in case of impact directly on the steel pole the force is very high thus the possibility of head injuries will be higher. In case of head impacting the energy absorption unit, the energy absorption unit absorbs the energy during the head impact and will significantly reduce the impact force on the head. (see FIG. 11B) As can be seen from the graph, the impact on the energy absorber unit (FIG. 11A) maintained a force level of less than or equal to 8 kN, while the pole impact (FIG. 10) exhibited a force exceeding 30 kN. This will reduce the chance of head injury damage.

In an embodiment, a road barrier energy absorption unit can comprise: a vehicle crush section configured to absorb impact energy when impacted with greater than or equal to 5 kN force; a post channel configured to receive a road barrier post; and a guardrail attachment. The energy absorption unit can be disposed over the post and a guardrail can attach to the energy absorption unit.

In an embodiment, a road barrier energy absorber system comprises: posts; road barrier energy absorption unit; and a guardrail extending between the energy absorber units. Each post is disposed in one of the energy absorber units. The energy absorber units comprise a vehicle crush section configured to absorb impact energy when impacted with greater than or equal to 5 kiloNewton (kN) force.

In an embodiment, a guardrail can comprise: an outer wall and stiffening elements, wherein the guardrail comprises a plastic.

In the various embodiments: (i) the unit further comprises a head impact section located below the vehicle crush section, and a second guard rail attachment, wherein the guard rail attachment aligns with the vehicle crush section, and wherein the second guard rail attachment aligns with the head impact section; and/or (ii) the unit a secondary energy absorber located on a side of the post channel opposite the vehicle crush section, and configured to absorb energy transferred from the vehicle crush section to the secondary energy absorber, and wherein, in use, the secondary energy absorber crushes against a horizontal surface to which the unit is attached; and/or (iii) the head impact section is configured to absorb 1 kJ to 10 kJ of energy during impact, wherein the vehicle crush section is configured to absorb 5 kJ to 40 kJ of energy during impact, and wherein the secondary energy absorber is configured to absorb greater than 30 kJ of energy during impact; and/or the secondary energy absorber is configured to absorb greater than 100 kJ to 200 kJ of energy during impact; and/or (iv) the unit further comprises a secondary energy absorber located on a side of the post channel opposite the vehicle crush section, and configured to absorb energy transferred from the vehicle crush section to the secondary energy absorber, and wherein, in use, the secondary energy absorber crushes against a horizontal surface to which the unit is attached; and/or (v) wherein the secondary energy absorber comprises stiffening elements; and/or (vi) wherein the vehicle crush section comprises stiffening elements; and/or (vii) the unit further comprises filled spaces between the stiffening elements; and/or (viii) wherein the road barrier energy absorption unit comprises a weatherable coating having a UV absorber; (ix) wherein the energy absorber units further comprise a head impact section located below the vehicle crush section, and a second guardrail attachment; and wherein the system further comprises a second guardrail extending between the second guardrail attachments and across the head impact section; and/or x) the system further comprises a secondary energy absorber located on a side of the post opposite the vehicle crush section, and configured to absorb energy transferred from the vehicle crush section through the post to the secondary energy absorber, and wherein, in use, the secondary energy absorber crushes against a horizontal surface to which the energy absorber units are attached; and/or (xi) the head impact section is configured to absorb 1 kJ to 10 kJ of energy during impact, wherein the vehicle crush section is configured to absorb 5 kJ to 40 kJ of energy during impact, and wherein the secondary energy absorber is configured to absorb greater than or equal to 30 kJ of energy during impact; and/or (xii) wherein the guardrail is a polymer guardrail; and/or (xiii) wherein the polymer guardrail comprises stiffening elements; and/or (xiv) the guardrail and the road barrier energy absorption unit comprises a weatherable coating having a UV absorber; and/or (xv) the guardrail can further comprise a weatherable coating on the outer wall, wherein the weatherable coating comprises a UV absorber; and/or (xvi) the guardrail is plastic; and/or (xvii) the guardrail comprises non-plastic reinforcement (e.g., within plastic walls); and/or the guardrail has a metal reinforcement; and/or (xviii) the guardrail has a reinforcement selected from a metal plate, metal wires, and combinations comprising at least one of the foregoing.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). "Combination" is inclusive of blends, mixtures, alloys, reaction products, and the like. Furthermore, the terms "first," "second," and the like, herein do not denote any order, quantity, or importance, but rather are used to differentiate one element from another. The terms "a" and "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. "Optional" or "optionally" means that the subsequently described event or circumstance can or cannot occur, and that the description includes instances where the event occurs and instances where it does not.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

As used herein, approximating language may be applied to modify any quantitative representation that may vary without resulting in a change in the basic function to which it is related. Accordingly, a value modified by a term or terms, such as "about" and "substantially," may not to be limited to the precise value specified, in some cases. In at least some instances, the approximating language may correspond to the precision of an instrument for measuring the value.

In general, embodiments may alternately comprise (e.g., include), consist of, or consist essentially of, any appropriate components herein disclosed. The embodiments may additionally, or alternatively, be formulated so as to be devoid, or substantially free, of any components, materials, ingredients, adjuvants or species used in the prior art compositions or that are otherwise not necessary to the achievement of the function and/or objectives of the embodiments.

As used herein, approximating language may be applied to modify any quantitative representation that may vary without resulting in a change in the basic function to which it is related. Accordingly, a value modified by a term or terms, such as "about" and "substantially," may not to be limited to the precise value specified, in some cases. In at least some instances, the approximating language may correspond to the precision of an instrument for measuring the value. Likewise, the term "operably connected" can refer to circumstances where two members are directly or indirectly joined such that motion can be transmitted from one member to the other member directly or via intermediate members. In another embodiment, the term refers to circumstances where two objects are joined in any desired form for example, mechanically, electronically, directly, magnetically, and the like.

What is claimed is:

1. A road barrier energy absorption unit, comprising:

a guardrail attachment; and a vehicle crush section defining a hollow and configured to be disposed between the guardrail and the road barrier post and to absorb impact energy and crush the hollow when exposed to a force that is greater than or equal to 5 kilo-newton (kN);

wherein the energy absorption unit defines a post channel configured to receive the road barrier post; and;

wherein the energy absorption unit can be disposed over the post and a guardrail can attach to the energy absorption unit.

2. The unit of claim 1, further comprising a head impact section located below the vehicle crush section, and a second guard rail attachment, wherein the guard rail attachment aligns with the vehicle crush section, and wherein the second guard rail attachment aligns with the head impact section.

3. The unit of claim 2, further comprising a secondary energy absorber located on a side of the post channel opposite the vehicle crush section, and configured to absorb energy transferred from the vehicle crush section to the secondary energy absorber, and wherein, in use, the secondary energy absorber crushes against a horizontal surface to which the unit is attached.

4. The unit of claim 3, wherein the head impact section is configured to absorb 1 kJ to 10 kJ of energy during impact, wherein the vehicle crush section is configured to absorb 5 kJ to 40 kJ of energy during impact, and wherein the secondary energy absorber is configured to absorb greater than or equal to 30 kJ of energy during impact.

5. The unit of claim 4, wherein the secondary energy absorber is configured to absorb greater than 100 kJ to 200 kJ of energy during impact.

6. The unit of claim 1, further comprising a secondary energy absorber located on a side of the post channel opposite the vehicle crush section, and configured to absorb energy transferred from the vehicle crush section to the secondary energy absorber, and wherein, in use, the secondary energy absorber crushes against a horizontal surface to which the unit is attached.

7. The unit of claim 6, wherein the secondary energy absorber comprises stiffening elements.

8. The unit of claim 1, wherein the vehicle crush section comprises stiffening elements.

9. The unit of claim 8, further comprising filled spaces between the stiffening elements.

10. The unit of claim 1, wherein the road barrier energy absorption unit comprises a weatherable coating having a UV absorber.

11. A road barrier energy absorber system, comprising posts;

road barrier energy absorption units; and a guardrail extending between the energy absorber units;

wherein each post is disposed in one of the energy absorber units, wherein each of the energy absorber units comprise a vehicle crush section configured to absorb impact energy when impacted with greater than or equal to 5 kN force, and a guardrail attachment wherein each absorption unit comprises front and rear crushable sections disposed on opposing sides of a respective post channel configured to receive a respective road barrier post and wherein the energy absorption unit can be disposed over the post and a guardrail can be attached to the energy absorption unit.

12. The system of claim 11, wherein the energy absorber units further comprise a head impact section located below the vehicle crush section, and a second guardrail attachment; and wherein the system further comprises a second guardrail extending between the second guardrail attachments and across the head impact section.

13. The system of claim 11, further comprising a secondary energy absorber located on a side of the post opposite the vehicle crush section, and configured to absorb energy transferred from the vehicle crush section through the post to the secondary energy absorber, and wherein, in use, the secondary energy absorber crushes against a horizontal surface to which the energy absorber units are attached.

14. The system of claim 12, wherein the head impact section is configured to absorb 1 kJ to 10 kJ of energy during impact, wherein the vehicle crush section is configured to absorb 5 kJ to 40 kJ of energy during impact, and wherein the secondary energy absorber is configured to absorb greater than 30 kJ of energy during impact.

15. The system of claim 11, wherein the guardrail is a polymer guardrail.

16. The system of claim 15, wherein the polymer guardrail comprises stiffening elements.

17. The system of claim 11, wherein the guardrail and the road barrier energy absorption unit comprises a weatherable coating having a UV absorber.

18. The road barrier energy absorption unit of claim 1, wherein the vehicle crush section is intended to crush progressively when exposed to the greater or equal to 5 kilonewton (kN) force.

19. The road barrier energy absorption unit of claim 1, comprising a rear crush section coupled to the vehicle crush section, with the energy absorption unit defining the road barrier post channel between them.

20. The road barrier energy absorption unit of claim 1, comprising a head impact section coupled with the vehicle crush section to be located on a common side of the road barrier post, below the vehicle crush section.

21. The road barrier energy absorption unit of claim 20, wherein the head impact section has a lower peak deformation force during impact than the vehicle crush section.

22. A road barrier energy absorption unit, comprising:

a guardrail attachment;

a vehicle crush section couple to the guardrail attachment and defining a plurality of vehicle crush hollows, the vehicle crush section configured to absorb impact energy when impacted with greater than or equal to 5 kN force; and a rear crush section coupled to the vehicle crush section, with the energy absorption unit defining a post channel between them to receive a road barrier post;

wherein the energy absorption unit can be disposed over the post and a guardrail can attach to the energy absorption unit.

23. The energy absorption unit of claim 22, wherein the post channel is shaped to conform to the road barrier post.

24. The energy absorption unit of claim 23, wherein the post channel is shaped to an I-beam shaped portion of the road barrier post.

* * * * *